US010252524B1

(12) United States Patent
Slotto et al.

(10) Patent No.: US 10,252,524 B1
(45) Date of Patent: Apr. 9, 2019

(54) PRINT HEAD HAVING INK PRESSURE SENSOR

(71) Applicant: XEROX CORPORATION, Norwalk, CT (US)

(72) Inventors: Steven Ross Slotto, Camas, WA (US); Jonathan R. Brick, Tualatin, OR (US); David L. Knierim, Wilsonville, OR (US); Chad J. Slenes, Sherwood, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/729,382

(22) Filed: Oct. 10, 2017

(51) Int. Cl.
*B41J 2/045* (2006.01)
*B41J 2/165* (2006.01)

(52) U.S. Cl.
CPC ..... *B41J 2/04573* (2013.01); *B41J 2/04586* (2013.01); *B41J 2002/16502* (2013.01)

(58) Field of Classification Search
CPC .... B41J 2/04573; B41J 2/04586; B41J 2/165; B41J 2/175; B41J 2/17596; B41J 2/17566; B41J 2/1404
See application file for complete search history.

(56) References Cited

U.S. PATENT DOCUMENTS

2014/0240406 A1* 8/2014 LaCaze ..... B41J 2/175 347/85

* cited by examiner

*Primary Examiner* — Thinh H Nguyen
(74) *Attorney, Agent, or Firm* — Miller Nash Graham & Dunn LLP

(57) ABSTRACT

An inkjet printing system, including an inlet in a print head to receive ink from an ink supply, a plurality of nozzles to eject ink in the print head, an ink pressure sensor disposed in an ink path, the ink pressure sensor configured to determine an ink pressure of the ink in the print head and output a signal indicating the ink pressure, and a controller in the print head configured to receive and process the signal indicating the ink pressure from the ink pressure sensor. The inkjet printing system may also include a memory to store an ink pressure and time profile. The controller may also output a signal to stop ejecting ink from the plurality of nozzles when the ink pressure is either below a negative threshold or above a positive threshold.

27 Claims, 7 Drawing Sheets

PRINT HEAD HAVING INK PRESSURE SENSOR

TECHNICAL FIELD

This disclosure relates to determining an ink pressure in an ink path located in a print head, and more particularly, to determining an ink pressure in an ink path inside a print head to diagnose ink supply issues or to avoid jetting ink if the ink pressure inside the print head exceeds a positive or negative pressure threshold.

BACKGROUND

Inkjet print systems include ink feed systems that ideally supply ink at appropriate ink pressures and temperatures to a print head. Print heads perform best when both ink pressure and temperature are within a specified range. On the other hand, print heads may have degraded print quality if an ink feed system supplies ink with pressure and/or temperature outside the specified range.

Failing ink supply systems that result in excessive ink pressures and/or temperatures can also cause print heads to fail more permanently due to the formation of air bubbles within single jet features that are difficult to refill with ink. These print heads may also fail due to clogged ink passageways from thick sludge caused by cooked ink upstream of the print head.

What is needed is a way to monitor the ink pressure of the ink in the print head to diagnose potential ink supply issues or to prevent a catastrophic failure of a print head.

SUMMARY

One embodiment of the disclosure includes an inkjet print head, including an inlet connected to an ink path to receive ink from an external ink supply, a plurality of nozzles to eject ink, an ink pressure sensor disposed in the ink path, the ink pressure sensor configured to determine an ink pressure of the ink in the print head ink path and output a signal indicating the ink pressure, and an internal controller configured to receive and act upon the signal from the ink pressure sensor. The inkjet print head may also transmit pressure readings to a printing system including a memory to store an ink pressure and time profile. The internal controller may also output a signal to stop ejecting ink from the plurality of nozzles when the ink pressure is below a negative threshold or above a positive threshold.

Another embodiment of the disclosure includes a method for monitoring an ink pressure in a print head, including performing a printing procedure with the print head, monitoring an ink pressure of ink in the print head during the printing procedure via an ink pressure sensor disposed in the print head, and performing a predetermined operation based on the ink pressure and the printing procedure. The printing procedure may be printing on an image receiving member, purging, or a printing initialization procedure and the predetermined operation includes storing an ink pressure and time profile based on the ink pressure and halting printing.

Other embodiments of the disclosure include a method for monitoring an ink pressure in a print head, including performing a printing operation with the print head, determining an ink pressure of ink in the print head during the printing operation via an ink pressure sensor disposed in the print head, and when the ink pressure is above a first threshold or below a second threshold, halt the printing operation.

DETAILED DESCRIPTION OF THE EMBODIMENTS

As used herein, the term "printer" generally refers to a system that applies an ink to print media and can encompass any system, such as a digital copier, book-making machine, facsimile machine, multi-function machine, etc., which performs a print outputting function for any purpose. The printer prints ink images on an image receiving member, and the term "image receiving member" as used herein refers to print media or an intermediate member, such as a drum or belt, which carries an ink image and transfers the ink image to a print medium. "Print media" can be a physical sheet of paper, plastic, or other suitable physical substrate suitable for receiving ink images, whether precut or web fed. As used in this document, "ink" refers to a liquid applied to an image receiving member to print an image. For example, ink can be aqueous ink, ink emulsions, melted phase change ink, or gel ink that has been heated to a temperature that enables the ink to be liquid for application or ejection onto an image receiving member and then return to a gelatinous state. A printer can include a variety of other components, such as finishers, paper feeders, and the like, and can be embodied as a copier, printer, or a multifunction machine. An image generally includes information in electronic form, which is to be rendered on print media by a marking engine and can include text, graphics, pictures, and the like.

The term "print head" as used herein refers to a component in the printer that is configured to eject ink drops onto the image receiving member. A typical print head includes a plurality of ink ejectors that are configured to eject ink drops of one or more ink colors onto the image receiving member. The ink ejectors are arranged in an array of one or more rows and columns. In some embodiments, the ink ejectors are arranged in staggered diagonal rows across a face of the print head. Various printer embodiments include one or more print heads that form ink images on the image receiving member. Some printer embodiments include a plurality of print heads arranged in a print zone. An image receiving member, such as a print medium or an intermediate member that holds a latent ink image, moves past the print heads in a process direction through the print zone, in some embodiments. The inkjets in the print heads eject ink drops in rows in a cross-process direction, which is perpendicular to the process direction across the image receiving member. An individual inkjet in a print head ejects ink drops that form a line extending in the process direction as the image receiving surface moves past the print head in the process direction. In other embodiments, the print head may move back and forth in the process direction to apply ink to the image receiving member.

Figure 1:
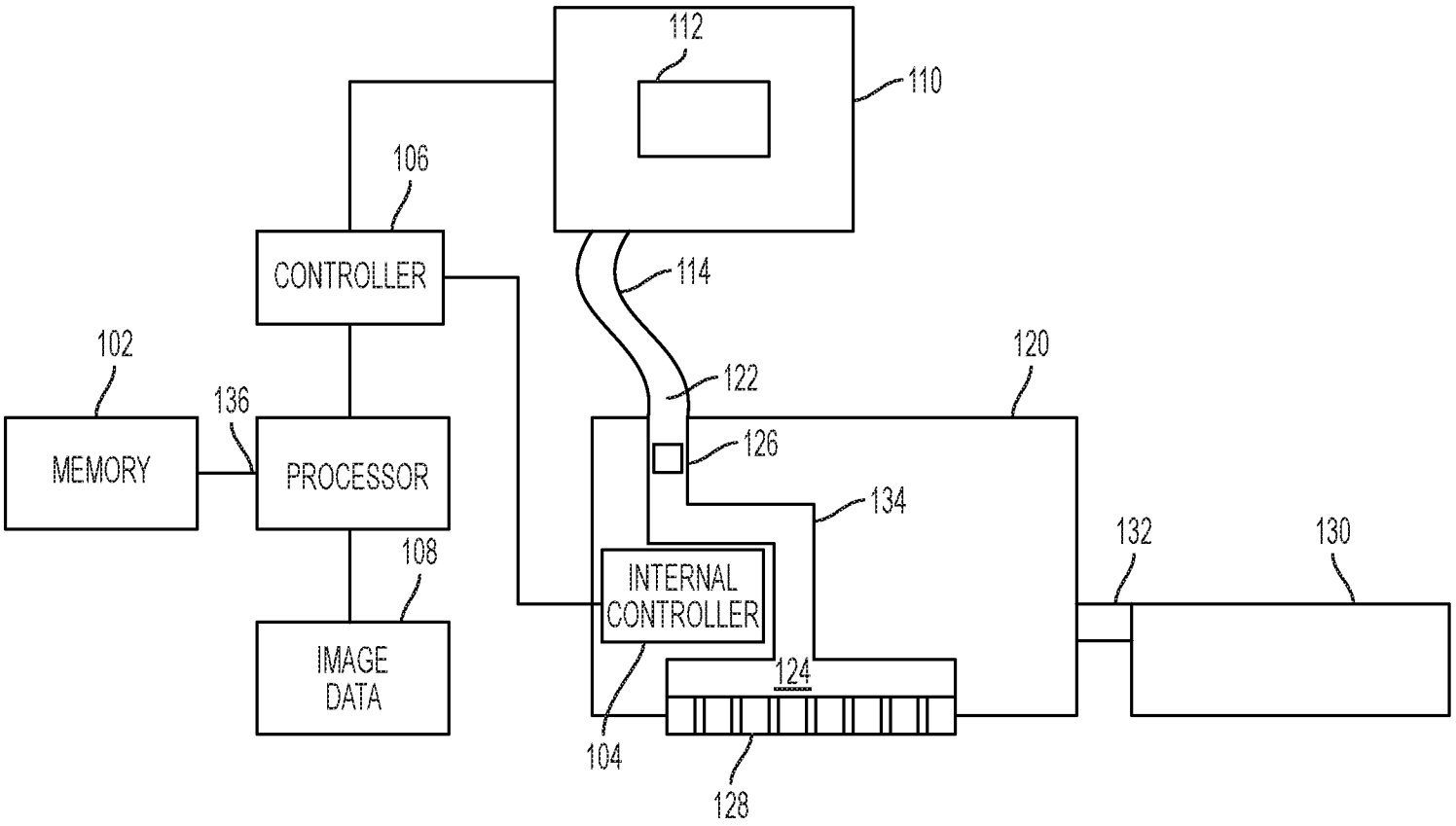
FIG. 1 is a schematic diagram of an inkjet printing system according to embodiments of the disclosure.

FIG. 1 illustrates an example inkjet printing system 100 including a memory 102, a print head 120 with an internal controller 104, a controller 106, a processor 136, and image data 108. The image data 108 may reside in memory 102 or other memory located in the inkjet printing system 100 or outside the inkjet printing system 100. In some embodiments, the processor 136 receives the image data 108 and processes the image data 108 to provide instructions to the controller 106. The controller 106 applies signals to both an external ink supply 110 and print head 120 in accordance with the instructions from the processor 136. The processor 136 may also provide instructions to controller 106 to perform other operations, such as a bring-up event, purging, etc.

The external ink supply 110 includes an ink feed system 112 and is coupled to the print head 120 through a conduit 114, also referred to herein as an ink supply tube. The ink feed system 112 may include, for example, a pump (not shown) to operate in a forward and reverse direction to push ink to or pull ink from the print head 120.

The print head 120 receives ink at an inlet 122 and the ink flows through ink path 134 which may include a manifold 124. An ink pressure sensor 126 is disposed in the ink path 134. The print head 120 includes inkjet ejectors 128 to eject ink onto an image receiving member or into an ink receptacle. The print head 120 also includes an ink return line 130 and an ink return line valve 132. When the return line valve 132 is open, ink may exit the print head to the ink return line 130.

The inkjet printing system 100 may also include additional features not shown in FIG. 1. For example, the inkjet printing system 100 may include a wiper assembly to wipe ink from a faceplate of the inkjet ejectors 128. As understood by one skilled in the art, the inkjet printing system 100 may include a plurality of print heads 120, each print head may be attached to a respective memory 102 and/or controller 106. Further, controller 106 may electrically communicate with another processor (not shown) of the overall inkjet printing system 100. In some embodiments, the print head 120 may not include an internal controller 104, but rather may communicate with a controller outside the print head 120, but with features similar to those of controller 104. Further, in some embodiments, the ink pressure sensor 126 may be electrically connected to the controller 106, rather than, or in addition to, internal controller 104. If the pressure sensor 126 is connected only to the controller 106, the controller 106 can perform the functions of the internal controller 104, discussed below.

In some embodiments, ink pressure sensor 126 may be connected directly to the processor 136, and the processor 136 may perform the various procedures discussed below.

The internal controller 104 and/or controller 106 can be implemented with general or specialized programmable processors that execute programmed instructions, for example, print head operation. The instructions and data required to perform the programmed functions may be stored in the memory 102, or in local memory within the processors or controllers. The processors, their memories, and interface circuitry configure the inkjet printing system 100 to form ink images, and, more particularly, to control the operation of jet ejectors 128 in the print head 120 to eject ink drops to form printed images. These components are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large-scale integration (VLSI) circuits. Also, the circuits described herein can be implemented with a combination of, or solely by, processors, FPGAs, ASICs, or discrete components. For example, in some embodiments, the internal controller 104 is a FPGA (Field Programmable Gate Array).

Disposing the ink pressure sensor 126 in the ink path inside the print head 120 allows for the ink pressure to be monitored locally within the print head 120 and confirm proper functioning of the ink feed system 112, which is external to the print head 120. Catastrophic ink feed situations often cause major perturbations in incoming ink pressure in the print head. In these situation, the print head 120 ink pressure sensor 126 readings cause the print head 120 to blank jet data to avoid permanent print head 120 failure. The ink pressure sensor 126, being tied electrically to the internal controller 104 and/or controller 106, allows jetting to be blanked, i.e., stopped, when the incoming ink pressure has become too high or too low, as discussed in more detail below.

Under less catastrophic conditions, readings from the ink pressure sensor 126 in the print head 120 do not blank jetting, but may provide diagnostic information useful in verifying and maintaining optimum printing conditions. In some embodiments, as discussed in more detail below, the incoming ink pressure may be monitored continuously by the ink pressure sensor 126 during printing. Some or all the ink pressure readings may be stored in memory 102. Sub-optimal ink feed conditions, such as restricted ink flow may be diagnosed by observing a reduced, that is, more negative, incoming ink pressure during high-fill portions of printing.

For example, the ink pressure sensor 126 may be used to confirm that an ink pressure profile of the print head 120 bring-up event, or printer initialization procedure, is acceptable, which includes higher ink pressure to purge ink through the print head 120 to clear air bubbles prior to printing. Optimum print head 120 bring-up events occur at a specified ink pressure and time profile. The ink pressure sensor 126 may monitor the ink pressure versus time during the print head 120 bring-up event and the readings may be forwarded on to controller 106 or processor 136 to save the ink pressure and time profile for diagnostic information in memory 102. This allows a user to determine if any bring-up event issues are related to ink supply versus print head faceplate wiping, or any other non-ink-feed issues.

Print head 120 usually requires purging and wiping prior to a normal operation. Purging pushes ink through the print head 120 to clear out air bubbles and partially-dried ink. Purging uses ink from the ink feed system 112 to feed the print head. Ink flows through the ink path and exists the print head 120 through the jet ejectors 128 during a jet stack purge and/or through an ink return line 130 during a manifold purge.

Purging typically involves providing positive ink pressure on the conduit 114 to the print head 120. For a manifold purge, an ink return valve 132 in the ink return line 130 is open to allow ink sent to the print head 120 to exit through the ink return line 130. For a jet stack purge, the valve 132 in the ink return line 130 is closed to allow ink to exit through the jet ejectors 128 and vents within the orifice plates of the print head 120. After purging, the faceplate of jet ejectors 128 is typically wiped. The ink feed system 112 may provide a slight positive pressure during wiping to prevent contaminated ink from being sucked back into the jet orifices. This initialization procedure is critical to proper print head 120 performance.

Figure 2:
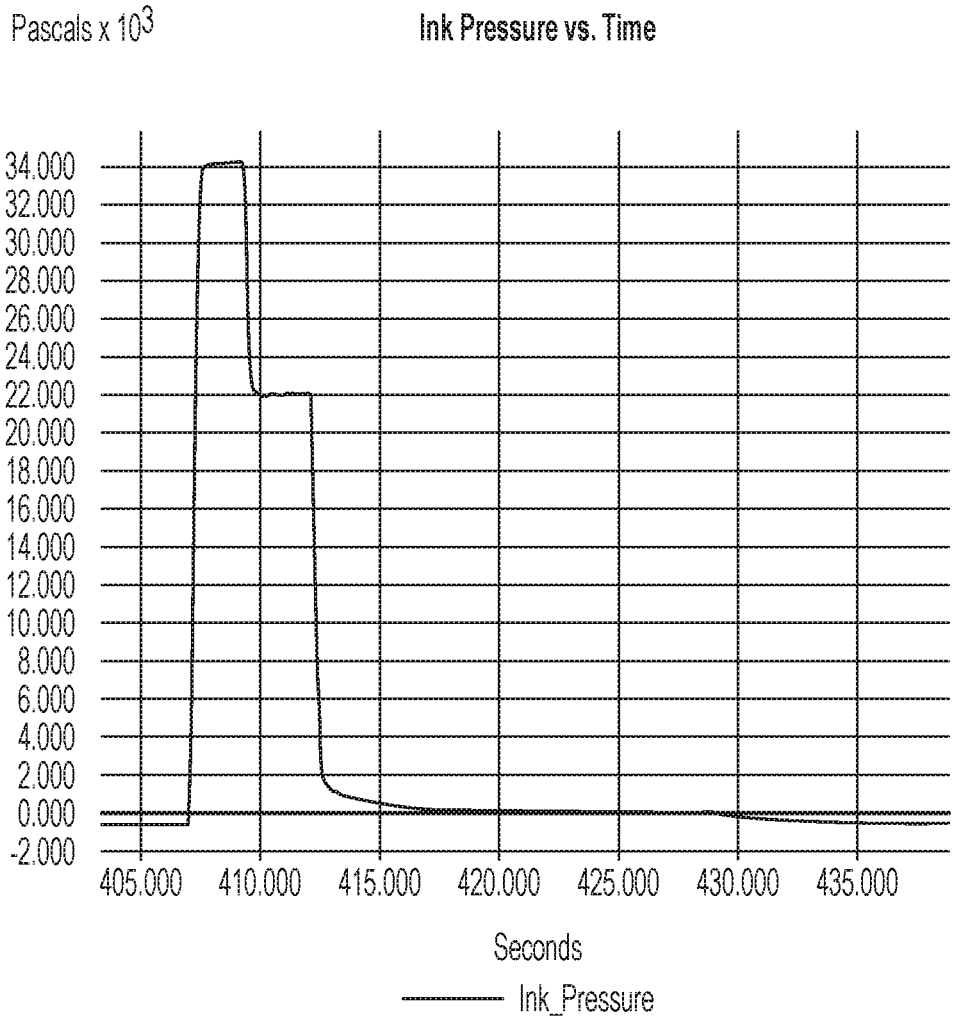
FIG. 2 illustrates an example ink pressure profile for a normal print head initialization procedure.

Monitoring the ink pressure during print head 120 initialization allows for any issues to be diagnosed by a user. FIG. 2 illustrates an example ink pressure and time profile for a normal print head 120 initialization procedure. As seen in FIG. 2, at approximately 407 seconds, the ink feed system 112 initiates a purge ink pressure. At 409 seconds, the ink return line 130 valve 132 is opened for a manifold purge, causing the ink pressure to drop from 34 kilopascals (KPa) to 22 KPa. At 412 seconds, the ink feed system 112 stops generating purge ink pressure and the ink pressure returns to its normal printing value of −500 Pascals (Pa) (−0.5 KPa) by the end of the graph in FIG. 2. The slight positive ink pressure from 415 seconds to 429 seconds in some embodiments may be used for wiping the face plate of jet ejectors 128.

Figure 3:
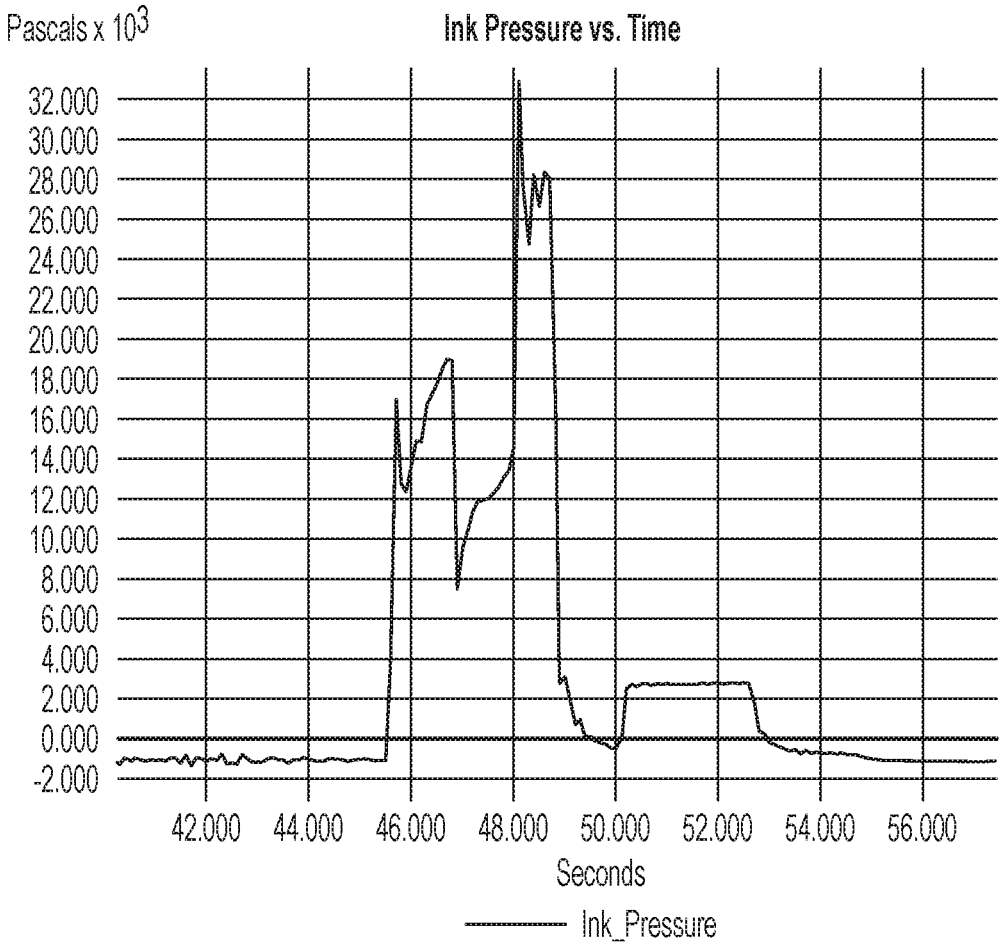
FIG. 3 illustrates an example ink pressure profile for during another print head initialization procedure.

FIG. 3, on the other hand, provides a purge ink pressure profile created by a different printing system, but for the same type of print head 120 as that of FIG. 2. As can be seen in FIG. 3, the pressure profile does not maintain as high a peak ink pressure. The lower resulting ink flow rate may not clear bubbles from the walls of the internal print head ink passage ways and print head 120 returns to a more negative printing pressure.

In some embodiments, a user may invoke the ink pressure monitoring during print head 120 initialization, through user inputs (not shown), to examine the ink pressure profile to determine if the ink pressure profile is as expected. The ink pressure information may be saved in a log file in the memory 102 when the ink pressure monitoring is invoked by a user.

In some embodiments, other printer state information may be recorded in the log file, such as a wiper location and speed, and state of the ink return line 130 valve 132.

In some embodiments, the ink pressure is continually monitored and saved in the log file. The processor 136 may examine the ink pressure profile saved in the log and flag any ink pressure profiles during printer initialization that do not meet the expected standards saved within the memory 102. For example, the processor 136 may check that ink pressure is above some minimum threshold, such as 30 KPa, for example, for a minimum time period, such as 2.5 seconds. Other thresholds and time periods may be used, as understood by one skilled in the art. The processor 136 may also monitor ink pressure after the purge operation, and during the wipe operation, to verify that ink pressure remains positive during the wipe operation, between 0 and 1 KPA for example, and then returns to a negative level within a maximum limit after wiping, such as 2 seconds or less. This data may be saved in the logfile in memory 102.

In some embodiments, a printing operation may not be enabled until the ink pressure profile of the print head 120 during printer initialization is within an acceptable standard. That is, if the processor 136 detects that the received pressure readings do not fit the acceptable standard, the processor 136 does not configure controller 106 for printing. In other embodiments, printing is allowed independent of the initialization ink pressure profile, but the initialization ink pressure profiles are saved in the log file for later examination by a user. All the log files may be saved until requested or only log files that have initializations that fall outside an expected range or standard are saved. The log files may also only be saved until memory 102 is full, and then new log files are saved over the oldest log files.

The ink pressure sensor 126 may also be used to monitor ink pressure during normal printing operations. Print heads, such as print head 120, often require back-pressure, i.e., some amount of negative pressure, applied to the ink supply for optimal print quality and to avoid ink drooling out of the jet ejectors 128. Print head 120 operational ink pressure is typically approximately −500 Pa, as discussed above. However, too little negative ink pressure can create poor image quality and/or drooling. Too much negative ink pressure can also cause poor image quality, including weak or missing jet ejectors 128.

Monitoring the ink pressure during normal printing may allow a user to diagnose a print issue. The ink pressure sensor 126 can confirm that the back-pressure set by the ink feed system 112 is within an acceptable range where it matters most, inside the print head 120 ink path, and just as important when it matters most, such as during normal printing operation.

Ink supply problems during a printing procedure may be difficult to diagnose, especially when the problems are transitory. For example, a kinked ink supply tube or conduit 114 does not affect the quiescent ink pressure, but causes excessive negative ink pressure during high-fill, i.e., high ink usage, portions of prints. Continuous monitoring of the ink pressure via the ink pressure sensor 126 in the print head 120 during normal printing may allow detection of such issues.

Figure 4:
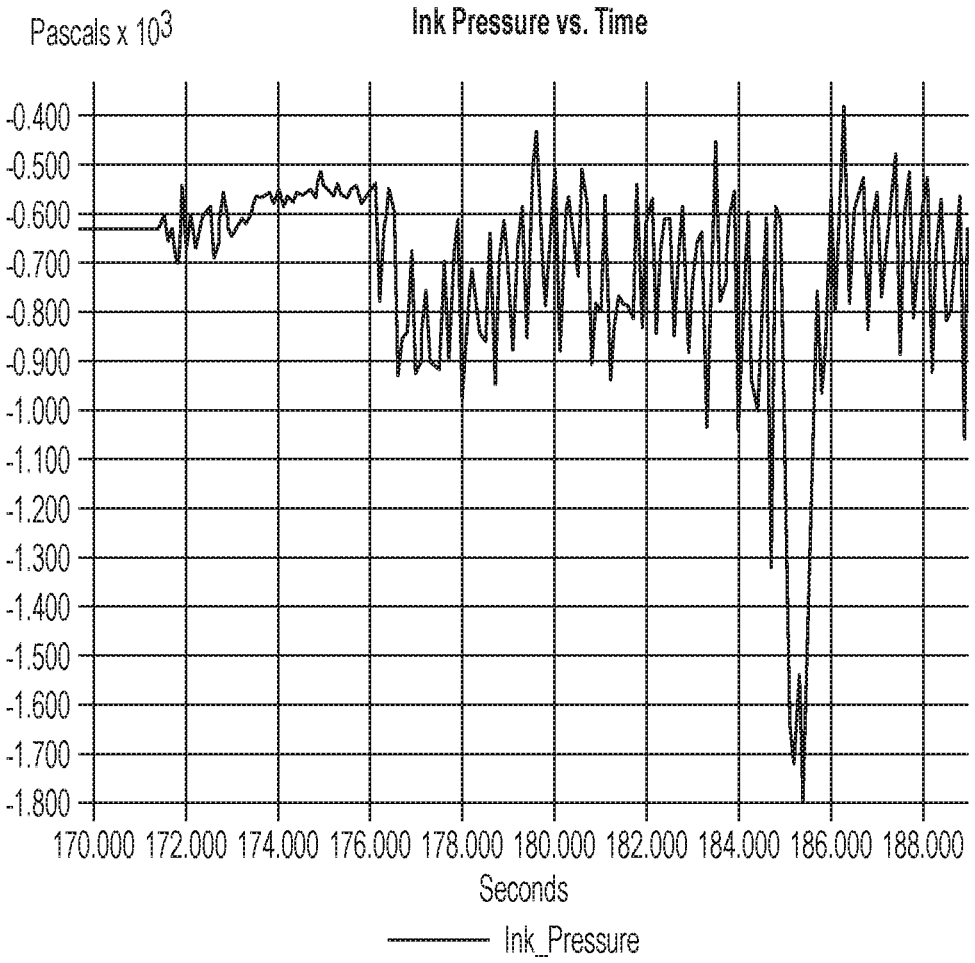
FIG. 4 illustrates an example ink pressure profile during a printing operation that experiences a pressure drop.

FIG. 4 illustrates an example ink pressure within print head 120 during a normal printing operation. Printing starts at roughly 171.5 seconds into the plot of FIG. 4, with a few low-fill images. Higher fill images start at 176 seconds causing some increased ink pressure drop. That is, there is more negative ink pressure starting at 176 seconds. Around 185 seconds, the ink feed hose, conduit 114, becomes pinched, restricting ink flow and further increasing the ink pressure drop. The excessive ink pressure drop around 185 seconds may cause subtle image quality artifacts. The cause of such artifacts is generally very difficult to diagnose. The fault was transitory and would not be detected by any monitoring further upstream in the ink feed system 112. The ink feed ink pressure sensor 126 integrated into the print head, however, detects this anomaly downstream of the conduit 114 while the print head 120 is operating in the normal production environment.

Similar to the print initialization operation discussed above, the ink pressure data may be recorded in a log file during the normal printing operation and later examined by a user after a user notices an image quality issue. Statistics about the printing images may also be recorded along with the ink pressure readings in the log file. For example, the number of ink drops per image, firing frequency, etc. may be recorded with the ink pressure reading in the log file.

Ink pressure may also be continually monitored by the internal controller 104 during the normal printer operation and forwarded on to the controller 106 and/or processor 136 only during anomalous events and a time period surrounding the anomalous events are recorded in the log file, as determined by the processor 136, with or without the printer statistics. Anomalous events may be defined as occurring when ink pressure readings exceed a predefined window, such as ink pressure readings outside a typical range of −200 to −1200 Pa.

In some embodiments, an anomalous event is defined as multiple readings outside a typical range, such as three or more readings, for example. However, as understood by one skilled in the art, any number of multiple readings may be set as a requirement for logging the anomalous event. Other filtering algorithms may also be used to define anomalous events that trigger the ink pressure logging. Such algorithms may be stored in the memory 102, and the ink pressure is compared with the events to determine if the ink pressure should be stored in the log file. Ink pressure may also be logged when requested by a user or by a specific service procedure.

As mentioned above, the ink pressure sensor 126 may also help prevent catastrophic failure of the print head 120. If the internal controller 104 receives a pressure reading that indicates a catastrophic event, such as excessively high or low ink pressure, during any printing procedure, the internal controller 104 forwards the ink pressure reading to controller 106, as well as a fault state indicating that the ink pressure violated either the negative threshold or the positive threshold. In some embodiments, the internal controller 104 may also blank jet data within print head 120 and forward the fault state to the controller 106 indicating that jetting was blanked due to excessively high or low ink pressure. In response to the fault state received, the controller 106 may cease sending jetting signals to print head 120. The controller 106 may latch the fault state to halt printing and forward the latched state as well as the readings to processor 136. The processor 136 logs the readings into the log file, with any additional information, as discussed above, so that a user may later review the pressure profile that lead to the too negative or too positive pressure.

This prevents the print head 120 from printing under either condition, avoiding potentially irreparable damage to the print head 120 when there is a failure somewhere else in the inkjet printing system 100, such as the ink feed system 112. Stopping the printing saves time and minimizes the amount of servicing needed for the print head 120, as well as the replacement of print head 120. A user may be able to diagnose the issue based off the saved ink pressure profile and service any needed components without print head 120 also needing to be serviced or replaced.

As mentioned above, ink feed system 112 can become blocked, either from a stuck valve, a kinked conduit 114, or other reasons, which causes the increase in the negative ink pressure inside the print head 120 while printing under these conditions. If the negative ink pressure becomes too great, air bubbles are ingested deeply into the single jet features of the jet ejectors 128, rendering particular jet ejectors 128 unusable. Field recovery of these missing jet ejectors 128 is difficult, or in some cases, impossible. A sensor in the ink feed supply 112 or in the ink supply 110 may not detect this blockage, but the ink pressure sensor 126 in the print head 120 is able to detect the ink pressure change. The internal controller 104 compares the ink pressure from the ink pressure sensor 126 to a negative threshold, such as −2000 Pa, and, if the ink pressure is below the threshold, the internal controller 104 forwards the ink pressure readings and a fault state to the controller 106.

Figure 5:
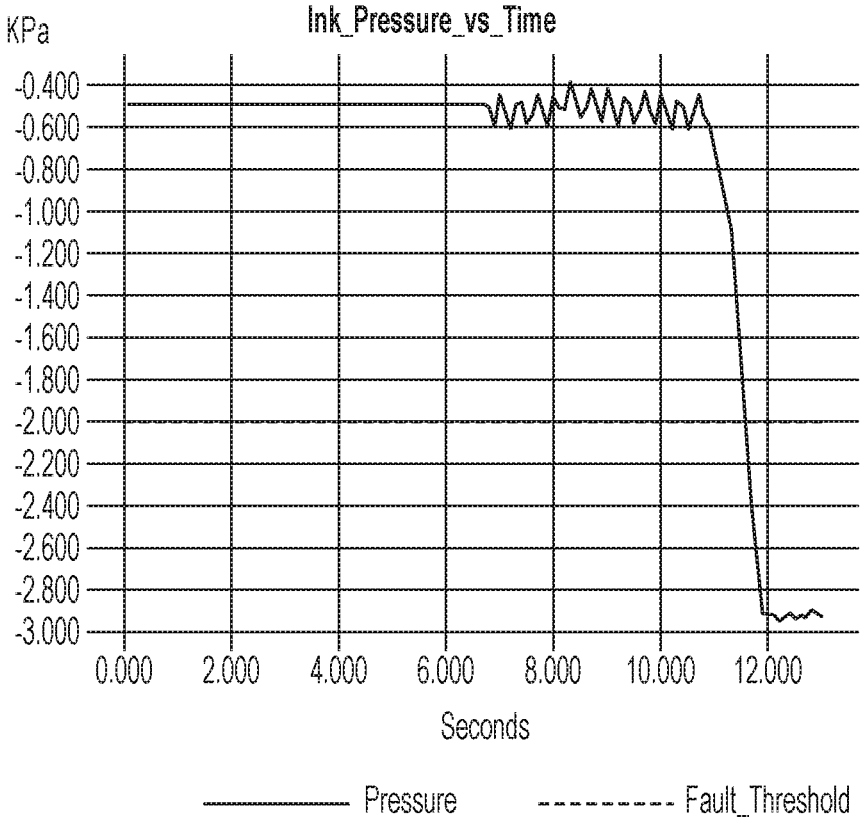
FIG. 5 illustrates an example ink pressure profile during a printing operation that experiences an excessive negative pressure.

FIG. 5 shows an example ink pressure profile of a print head 120 that experiences too great of negative ink pressure. Printing starts at approximately 6.6 seconds, which causes small ink pressure deviations from the nominal −500 Pa back-ink pressure. At 11 seconds, the ink feed system 112 fails to provide further ink, causing a sharp decline in the ink pressure, as detected by the ink pressure sensor 126 and determined by the internal controller 104. Once the ink pressure reaches a threshold, −2000 Pa in this example, the internal controller 104 may blank jetting data within print head 120. In other embodiments, the internal controller 104 may signal a fault state to the controller 106, and the controller 106 latches the fault state and forwards the pressure readings to the processor 136. The controller 106 may also cease sending jetting signals to print head 120 based on the latched fault state. Since blanking is not instantaneous, the final ink pressure is below −2000 Pa, but the jetting is stopped in time to avoid harm to the print head 120. The threshold is set and saved in internal controller 104 and should be a value that will prevent damage to print head 120. The threshold value may be different for different print heads 120 and/or different inkjet printing systems 100.

Another fault that may occur in ink feed systems 112 is loss of the negative ink pressure from the ink supply 110, resulting in ink pressure in the print head 120 that is too positive. This fault typically causes ink from the ink supply 110 to drain through the print head 120. Such an ink-drain event is already problematic, but becomes worse if the print head 120 continues to jet ink. Jetting pulls ink through the print head 120 until air behind the ink is pulled into the print head 120 and eventually deep into internal print head 120 single jet features of the jet ejectors 128, making field recovery of missing jet ejectors 128 difficult or impossible.

In many ink jet printing systems, print heads jet downwards, so the jet ejectors 128 are at the bottom of the print head, so that ink in the ink supply 110 above the print head has a lower, or more negative, ink pressure than the jet ejectors 128 due to gravity, ink density, and the vertical distance from the jet ejectors 128 to the ink supply. The operational ink pressure, −500 Pa for example, of the print head 120 is measured at the orifice level. Ink is fed to the print head 120 nearer the top through port 122, and often from the ink supply 110 further above the print head 120. To maintain the operational ink pressure of the print head 120, the ink supply 110 ink pressure must be controlled to a lower, more negative, level.

For example, if ink density is 1100 kg/m3, acceleration due to gravity is 9.8 m/s2, the ink supply 110 free surface is 0.4 m above the jet ejectors 128, and the ink pressure to eject ink at the jet ejectors 128 is −500 Pa, then the ink supply ink pressure must be −4812 Pa, which is determined by multiplying the ink density by the acceleration due to gravity by the free surface between the ink supply 110 and the jet ejectors 128, and adding the ink pressure to eject ink at the jet ejectors. A negative ink pressure of −4812 Pa is typically applied to the air space above the ink in the ink supply 110.

When the ink supply 110 vacuum is initially lost, operational ink pressure within the print head 120 becomes positive, such as by 4312 Pa, using the above-example. The ink pressure sensor 126 can detect this ink pressure and sends it to the internal controller 104. The internal controller 104 compares the ink pressure from the ink pressure sensor 126 to a positive threshold, such as 1000 Pa. In this example, the ink pressure of 4312 Pa is well above the positive threshold, so the internal controller forwards the ink pressure, as well as a fault state, to the controller 106

Figure 6:
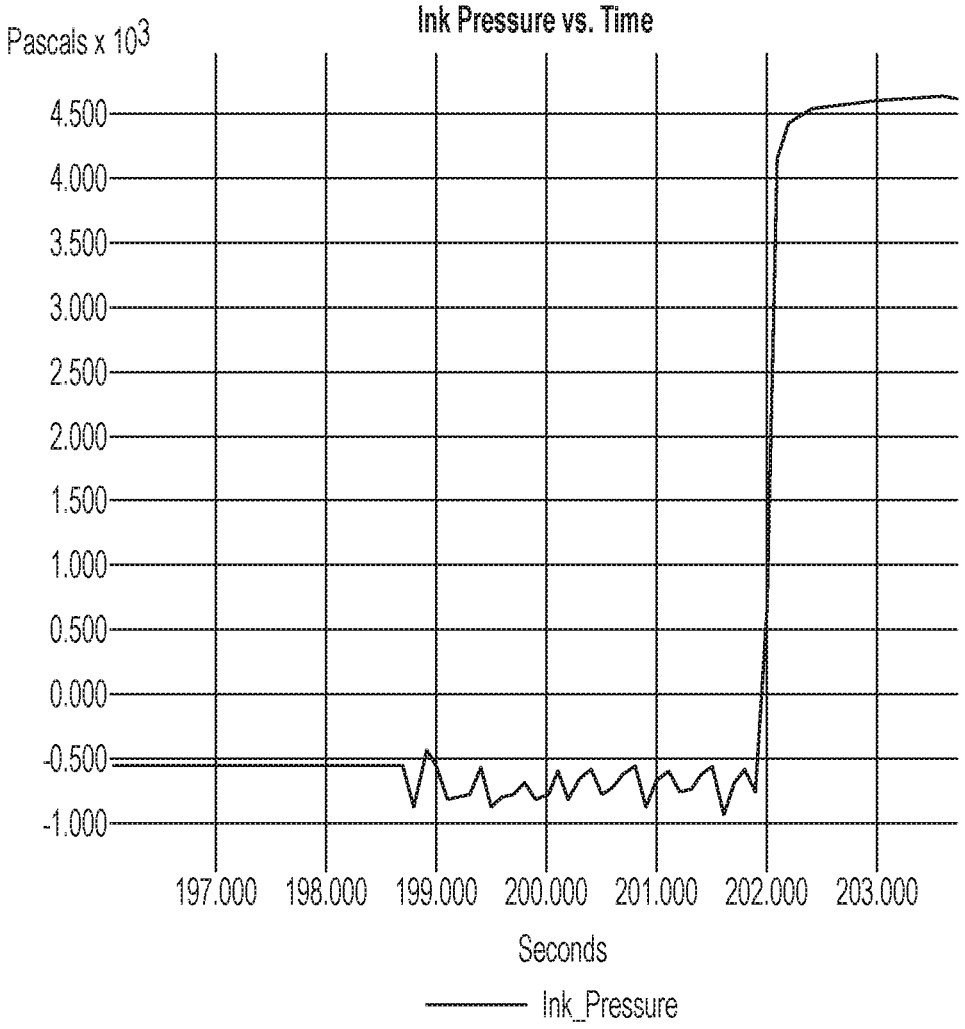
FIG. 6 illustrates an example ink pressure profile during a printing operation that experiences an excessive positive pressure.

FIG. 6 illustrates an example of an ink pressure profile within a print head 120 during printing. Printing begins just before 199 seconds, which causes small ink pressure deviations from the nominal −500 Pa back-ink pressure. At 202 seconds, the ink feed system 112 loses vacuum, causing a sharp increase in ink pressure, as seen on the plot of FIG. 6. Once the ink pressure reaches 1000 Pa, the internal controller 104 sets a fault state and blanks jetting data within print head 120, and communicates the fault state to the controller 106. In response, controller 106 latches the fault state and ceases sending jetting signals to print head 120. Ink may start drooling out of the jet ejectors 128, but the lack of jetting prevents air behind the ink from being pulled into the print head 120, or at least from the internal single-jet features, where the air is difficult to remove.

In some embodiments, the jet data blanking of the print head 120 lasts as long as the excessive positive ink pressure condition remains or as long as the excessive negative ink pressure condition remains. If the internal controller 104 detects readings from the ink pressure sensor 126 indicating that the ink pressure has dropped below a threshold, such as −100 Pa for an excessive high ink pressure scenario, for example, or above −2000 Pa for an excessive negative ink pressure scenario, the internal controller 104 clears its fault state and ends blanking of jet data within print head 120. Internal controller 104 also sends a fault-clear state to the controller 106, causing controller 106 to resume sending printing signals to print head 120 to begin ejecting ink through the jet ejectors 128. Generally, no print head 120 intervention is required when the ink feed system 112 is returned to proper operation.

In other embodiments, the internal controller 104 or the controller 106 latches the fault state detected by the internal controller 104 and jetting remains disabled until a user or a high-level system controller (not shown) in the printing system re-enables the print head 120. This prevents a partially-blocked ink feed system 112 from causing jetting to cycle on and off as the pressure rises and falls.

For positive pressure faults, latching is of a particular value. Under positive pressure, ink drains through the print head until the ink supply is exhausted. Once ink has drained, pressure returns to roughly zero, but a serious fault (no ink) still exists. Without latching the fault state, jetting could resume after most of the ink drains and the ink pressure approaches zero.

Hysteresis may be used as a form of latching to prevent jetting as ink drains and the ink pressure approaches zero during a fault condition. For example, different rising and falling fault thresholds may be used.

The print head 120 may also maintain a maximum ink pressure reading in some embodiments. This maximum reading may be used as an alternate mechanism to determine that a fault occurred, and to assist in determining the nature of the fault. The maximum reading can be reset in the internal controller 104 by the printing system.

Figure 7:
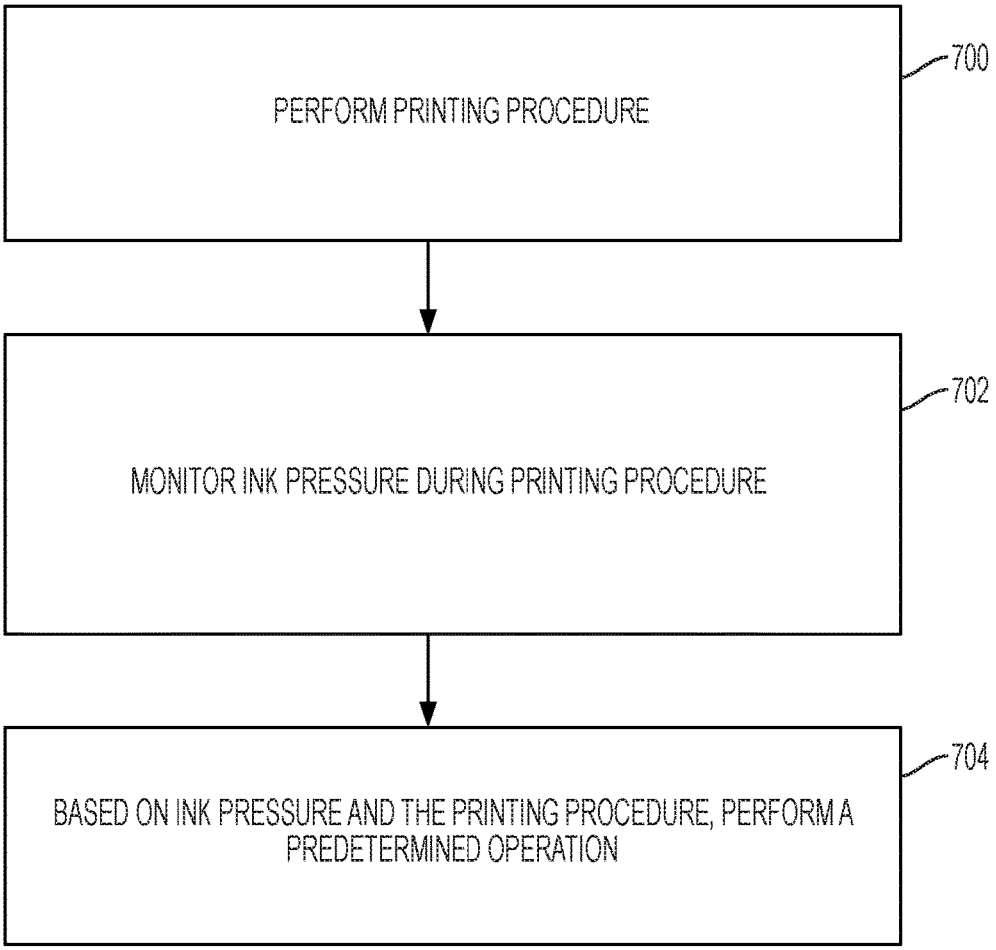
FIG. 7 illustrates a process performed by the printer based on an ink pressure in the print head.

FIG. 7 illustrates a method performed by the inkjet printing system 100 based on the ink pressure of the ink detected by the ink pressure sensor 126. A printing procedure is performed 700. The printing procedure may be any of the procedures discussed above, such as printing on an image receiving member, purging, wiping, a printing initialization procedure, etc. During the printing procedure, the ink pressure of ink in the print head is monitored 702 via the ink pressure sensor 126 disposed in the print head 120. A predetermined operation is performed 704 based on the ink pressure and the printing procedure.

As mentioned above, the predetermined operation includes storing an ink pressure and time profile based on the ink pressure and halting printing. Printer state information and printer statics may be stored with the ink pressure and time profile. As also mentioned above, in some embodiments, printing may be enabled when a predetermined printing initialization ink pressure and time profile meets a predetermined standard.

The printing procedure may be halted when the ink pressure is below a negative threshold or above a positive threshold to avoid damage to the print head 120. A fault state may also be set in the inkjet printing system 100 when the ink pressure is below a negative threshold or above a positive threshold.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An inkjet printing system, comprising:

a print head including an ink path to receive ink from an external ink supply;

a plurality of nozzles to eject ink in the print head;

an ink pressure sensor disposed in the ink path, the ink pressure sensor configured to determine an ink pressure of the ink in the print head and output a signal indicating the ink pressure;

a processor;

a memory configured to store an ink pressure and time profile; and a controller configured to receive and process the signal indicating the ink pressure from the ink pressure sensor and forward the signal indicating the ink pressure to the processor.

2. The inkjet printing system of claim 1, in which printer state information is stored with the ink pressure and time profile.

3. The inkjet printing system of claim 2, in which printer state information includes a wiper location, a wiper speed, and/or a state of a valve.

4. The inkjet printing system of claim 1, in which printer statistics are stored with the ink pressure and time profile.

5. The inkjet printing system of claim 4, in which printer statics includes a number of ink drops per image and/or firing frequency.

6. The inkjet printing system of claim 1, in which the processor is configured to enable printing when a predetermined printing initialization ink pressure and time profile meets a predetermined standard.

7. The inkjet printing system of claim 6, in which the predetermined standard includes holding the ink pressure above a minimum threshold for a minimum amount of time.

8. The inkjet printing system of claim 1, in which the processor is further configured to store the ink pressure and time profile when the ink pressure and time profile is outside a predetermined standard.

9. The inkjet printing system of claim 1, in which the controller continuously monitors the ink pressure of the ink and the controller is further configured to send the signal indicating the ink pressure to the processor to store ink pressure and time profiles that do not meet a predetermined standard into the memory.

10. The inkjet printing system of claim 1, in which the controller is further configured to set a fault state when the ink pressure is either below a first lower threshold or above a first upper threshold.

11. The inkjet print head of claim 10, in which the controller is further configured to clear the fault state when the ink pressure is either above a second lower threshold or below a second upper threshold.

12. The inkjet print head of claim 10, in which the controller is further configured to prevent ink ejection during the fault state.

13. The inkjet print head of claim 10, further comprising an external controller connected to the controller, in which the controller is further configured to output the fault state to the external controller when the ink pressure is either below the first lower threshold or above the first upper threshold, and the external controller is configured to halt printing when the fault state is received.

14. The inkjet print head of claim 13, further comprising a processor connected to the external controller, in which the external controller is further configured to output the ink pressure and the fault state to the processor, and the processor is further configured to store the ink pressure in a memory.

15. A method for monitoring an ink pressure in a print head, comprising:

performing a printing procedure with the print head;

monitoring the ink pressure of ink in the print head during the printing procedure via an ink pressure sensor disposed in the print head; and performing a predetermined operation based on the ink pressure and the printing procedure, in which the predetermined operation includes storing an ink pressure and time profile based on the ink pressure.

16. The method of claim 15, in which the printing procedure includes printing on an image receiving member, purging, or a printing initialization procedure.

17. The method of claim 16, further comprising enabling printing when a predetermined printing initialization ink pressure and time profile meets a predetermined standard.

18. The method of claim 17, in which the predetermined standard includes holding ink pressure above a minimum threshold for a minimum amount of time.

19. The method of claim 15, further comprising storing printer state information with the ink pressure and time profile.

20. The method of claim 19, in which printer state information includes a wiper location, a wiper speed, and/or a state of a valve.

21. The method of claim 15, further comprising storing printer statistics with the ink pressure and time profile.

22. The method of claim 21, in which printer statics includes the number of ink drops per image and/or firing frequency.

23. The method of claim 15, in which the printing procedure includes printing on an image receiving member, and the operation includes setting a fault state when the ink pressure is below a first lower threshold or above a first upper threshold.

24. The method of claim 23, further comprising halting printing when the fault state is set.

25. A method for monitoring an ink pressure in a print head, comprising:

performing a printing operation with the print head;

determining an ink pressure of ink in the print head during the printing operation via an ink pressure sensor disposed in the print head;

when the ink pressure is above a first upper threshold or below a first lower threshold, halt the printing operation, and after the printing operation is halted, resuming the printing operation when the ink pressure is below a second upper threshold or above a second lower threshold.

26. The method of claim 25, in which the first upper threshold is a positive pressure threshold and the first lower threshold is a negative pressure threshold.

27. The method of claim 25, in which the second upper threshold is equal to or lower than the first upper threshold and the second lower threshold is equal to or above the first lower threshold.

* * * * *